US006506985B2

(12) United States Patent
Konda

(10) Patent No.: US 6,506,985 B2
(45) Date of Patent: Jan. 14, 2003

(54) SLIDE SWITCH INCLUDING RECIPROCATING TO RECIPROCATING MOVEMENT BETWEEN ACTUATOR ASSEMBLY AND DISPLACED MOVABLE CONTACT STRUCTURE

(75) Inventor: Kazumoto Konda, Nagoya (JP)

(73) Assignees: Autoneworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/988,761

(22) Filed: Nov. 20, 2001

(65) Prior Publication Data

US 2002/0066654 A1 Jun. 6, 2002

(30) Foreign Application Priority Data

Dec. 1, 2000 (JP) ..... 2000-367586

(51) Int. Cl.[7] ..... H01H 9/02; H01H 15/02
(52) U.S. Cl. ..... 200/17 R; 200/16 E
(58) Field of Search ..... 200/16 R, 16 B, 200/16 E, 17 R, 18, 303

(56) References Cited

U.S. PATENT DOCUMENTS 3,187,120 A * 6/1965 Akst ..... 200/16 E
3,280,275 A * 10/1966 Sheffield et al. ..... 200/16 E
3,796,845 A * 3/1974 Shirae ..... 200/17 R
4,563,549 A * 1/1986 Lycan ..... 200/1 V
4,639,558 A * 1/1987 Lycan ..... 20/16 E
4,737,603 A * 4/1988 Lycan ..... 200/18
5,831,228 A 11/1998 Kuki et al. ..... 200/16 E
5,842,560 A 12/1998 Kuki et al. ..... 200/43.05
5,847,338 A * 12/1998 Kuki et al. ..... 200/17 R

FOREIGN PATENT DOCUMENTS

JP A 2000-235824 8/2000

* cited by examiner

*Primary Examiner*—J. R. Scott
(74) *Attorney, Agent, or Firm*—Oliff & Berridge, PLC

(57) ABSTRACT

In the stationary side housing 10, there are provided four pin-type stationary electrodes 13 which are insulated from each other. In the movable side housing 20, there are provided movable electrodes 23 by which the stationary electrodes 13 can be electrically continued to each other when the movable electrodes 23 are engaged with the stationary electrodes 13. In the stationary side housing 10, there is provided a hood section 12A. In the movable side housing 20, there is provided a slit 25 for receiving the hood section 12A. Both the housings 10 and 20 are guided in the engaging direction of the movable electrode 23 with the stationary electrode 13 by the action of the hood section 12A and the slit 25. In the movable side housing 20, there is provided a movable plate 31 in the longitudinal direction. On this movable plate 31, there is provided an oblique groove 34, which is obliquely formed, engaging with the hood section 12A of the stationary side housing 10.

5 Claims, 5 Drawing Sheets

SLIDE SWITCH INCLUDING RECIPROCATING TO RECIPROCATING MOVEMENT BETWEEN ACTUATOR ASSEMBLY AND DISPLACED MOVABLE CONTACT STRUCTURE

BACKGROUND OF THE INVENTION

1. Technical Field

The present invention relates to a breaker device by which a circuit is closed when a movable electrode is engaged with a pair of stationary electrodes.

2. Related Art

This type breaker device is disclosed, for example, in Japanese Unexamined Patent Application Publication No. 2000-235824. This breaker includes: a stationary side housing having a pair of stationary electrodes; and a movable side housing having a pair of movable electrodes, wherein both the movable electrodes are short-circuited by the movable side housing. When the movable side housing is engaged with the stationary side housing, the pair of movable electrodes are engaged with the pair of stationary electrodes, and the pair of stationary electrodes are electrically short-circuited. When a handle provided in the movable side housing is pulled so that the movable side housing can be pulled out from the stationary side housing, a circuit formed between the stationary electrodes is opened.

According to the above arrangement, the structure of the breaker device is simple. Therefore, the above arrangement is suitable when a high intensity of electric current is made to flow and shut off. For example, the above arrangement is suitably used for a power circuit of an electric car or hybrid car.

Problems to be solved

However, in this type breaker device, it is necessary to provide a relatively large space, in which an engagement work is conducted on this breaker, in the engaging direction of the movable electrode. Especially when the movable side housing is drawn out, a worker holds the handle with his hand and draws the movable side housing all at once. Therefore, unless a sufficiently large space is ensured, the worker may be wounded in his hand. However, it is difficult to ensure a sufficiently large space in the bonnet of a car. In view of the above problems, improvements are required.

SUMMARY OF THE INVENTION

The present invention has been accomplished in view of the above circumstances. It is an object of the present invention to provide a breaker device in which only a small space is required in the engaging direction of both electrodes.

Means for Solving the Problems

As a means for accomplishing the above object, the present invention provides a breaker device comprising: a stationary side housing having a pair of stationary electrodes which are insulated from each other; a movable side housing having a pair of movable electrodes for putting both the stationary electrodes in a state of electrical continuity when the movable electrodes are engaged with the pair of stationary electrodes; a guide rail arranged in both the housings, for guiding both the housings in an engaging direction of the movable electrode with the stationary electrodes; an idle pin provided in the stationary side housing; a movable plate arranged in the movable side housing, incapable of moving in the engaging direction of the movable electrode with the stationary electrodes, capable of moving in a direction perpendicular to the engaging direction of the movable electrode with the stationary electrodes; and an oblique groove open to a side edge of the movable plate opposed to the stationary side housing, the oblique groove being oblique to a moving direction of the movable plate.

Two movable plates may be provided along the inside of a pair of side walls of the movable side housing. The two movable plates are connected with each other at one end side being formed into a C-shape, and a handle section is integrally formed in the connecting section.

A through-hole may be formed in the connecting section. A detecting protruding section capable of entering the through-hole is formed on a wall corresponding to the connecting section in the movable side housing, and the oblique groove of the movable plate is set so that both the electrodes are engaged with each other when the detecting protruding section is moved penetrating the through-hole. The detecting protruding section may be formed at an end of a connecting pin for attaching the movable electrode to the movable side housing. The end of the detecting protruding section may be of a different color from that of the connecting section.

In one arrangement, an electric wire of a circuit, in which an electric current is made to flow or shut off, is connected with each of the pair of stationary electrodes. In order to close the circuit, the movable electrodes are engaged with the pair of stationary electrodes. In order to engage the movable electrodes with the pair of stationary electrodes, the movable side housing is set at the stationary side housing, and the idle pin of the stationary side housing is inserted into the oblique groove of the movable plate of the movable side housing. Then, the movable plate is moved with respect to the movable side housing. At this time, the movable plate is incapable of moving in the engaging direction of the movable electrode with the stationary electrode, however, the movable plate is capable of moving in a direction perpendicular to the engaging direction of the movable electrode with the stationary electrode. Therefore, as the idle pin enters the oblique groove, the movable plate is given a force in the engaging direction of the movable electrode with the stationary electrode. As a result, the movable side housing enters the stationary side housing so that the movable electrode can be engaged with the pair of stationary electrodes.

On the other hand, in order to open the circuit, the movable plate may be moved in a direction opposite to the direction described above. As the movable plate is moved, the movable electrode is drawn out from the pair of stationary electrodes by a force given between the movable plate and the idle pin. Finally, the movable electrode is separated from the pair of stationary electrodes.

In this arrangement, the movable plate is moved in a direction perpendicular to the engaging direction of both the electrodes. Accordingly, it is unnecessary to provide a redundant space in the engaging direction of both the electrodes.

In embodiments, there are provided two movable plates along both side walls of the movable side housing. Accordingly, it is possible to move the movable side housing without causing deviation of a force. Therefore, the engaging operation can be smoothly conducted. Further, since the handle is located at the center of the two movable plates, operation can be easily carried out.

In embodiments, both the electrodes are engaged with each other at a point of time when the detection protruding section penetrates the through-hole, which is convenient because completion of the engagement of both the electrodes can be observed from the operation side.

In embodiments, the detection protruding sect ion is composed by utilizing the connection pin for attaching the movable electrode to the movable side housing. Therefore, the structure is reasonable. When the color of the detection protruding section is different from that of the connecting section, a state of penetration of the detection protruding section into the through-hole can be easily confirmed, that is, confirmation of the engagement can be more easily made.

BRIEF DESCRIPTION OF THE DRAWINGS

FIG. 1 is a cross-sectional view showing a state in which a circuit is opened.

DETAILED DESCRIPTION OF THE PREFERRED EMBODIMENTS

Figure 1:
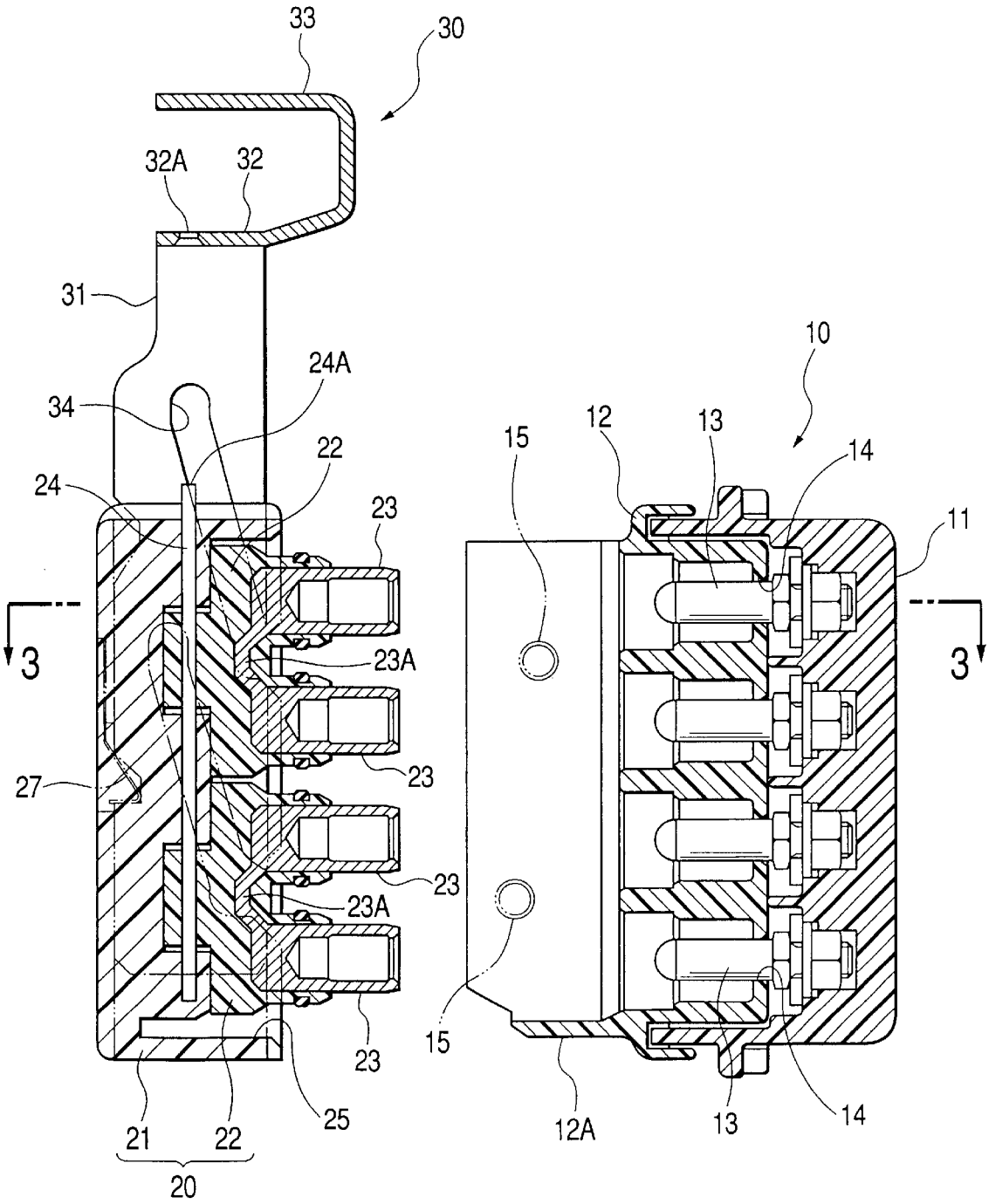
FIG. 1 relates to an embodiment of the present invention, that is.

Referring to the accompanying drawings, an embodiment of the present invention will be explained below.

Reference numeral 10 is a stationary side housing, the profile of which is formed into a box-shape and one face side of the box-shaped stationary side housing is open. For example, the stationary side housing 10 includes: a base housing 11 which is fixed to, for example, a body of an automobile; and a cover housing 12 engaged with an open face of the base housing 11. In the base housing 11, four pin-type stationary electrodes 13 are arranged and fixed. In the cover housing 12, there are provided four insertion holes 14 into which the pin-type stationary electrodes 13 are inserted. The periphery of each insertion hole 14 is cylindrical. Therefore, the movable electrode 23 described later can be accommodated in the insertion hole 14.

On the other hand, the movable side housing 20 incluides: a cover 21; and two electrode mold bodies 22 accommodated in cover 21. In each electrode mold body 22, two movable electrodes 23, which are formed into a pair, are arranged by means of resin molding. These movable electrodes 23 are capable of engaging with the two stationary electrodes 13 which are adjacent to each other. The two movable electrodes 23 are connected with each other by the short-circuit piece 23A. Therefore, the two movable electrodes 23 are electrically short-circuited with each other. Accordingly, when the two movable electrodes 23 are engaged with the two stationary electrodes 13 which are adjacent to each other, the movable electrodes 23 and the stationary electrodes 13 are electrically short-circuited to each other. One connecting pin 24 penetrates these electrode mold bodies 22 and the cover 21. By this connecting pin 24, the electrode mold bodies 22 are attached to the cover 21 so that the electrode mold bodies 22 can not come off from the cover 21. In this connection, an inner diameter of the trough-hole of the electrode mold body 22 is a litter larger than an outer diameter of the connecting pin 24. Therefore, the electrode mold body 22 is allowed to be rickety in the cover 21 in a predetermined range. Due to the foregoing, an alignment of the engagement of the movable electrode 23 with the stationary electrode 13 can be automatically adjusted. An end of the connecting pin 24 protrudes from the cover 21 by a predetermined length, which composes the detection protruding section 24A in the present invention. In this connection, a forward end of the detection protruding section 24A is coated with red coating which is different from the color of the movable plate 31 described later.

Figure 2:
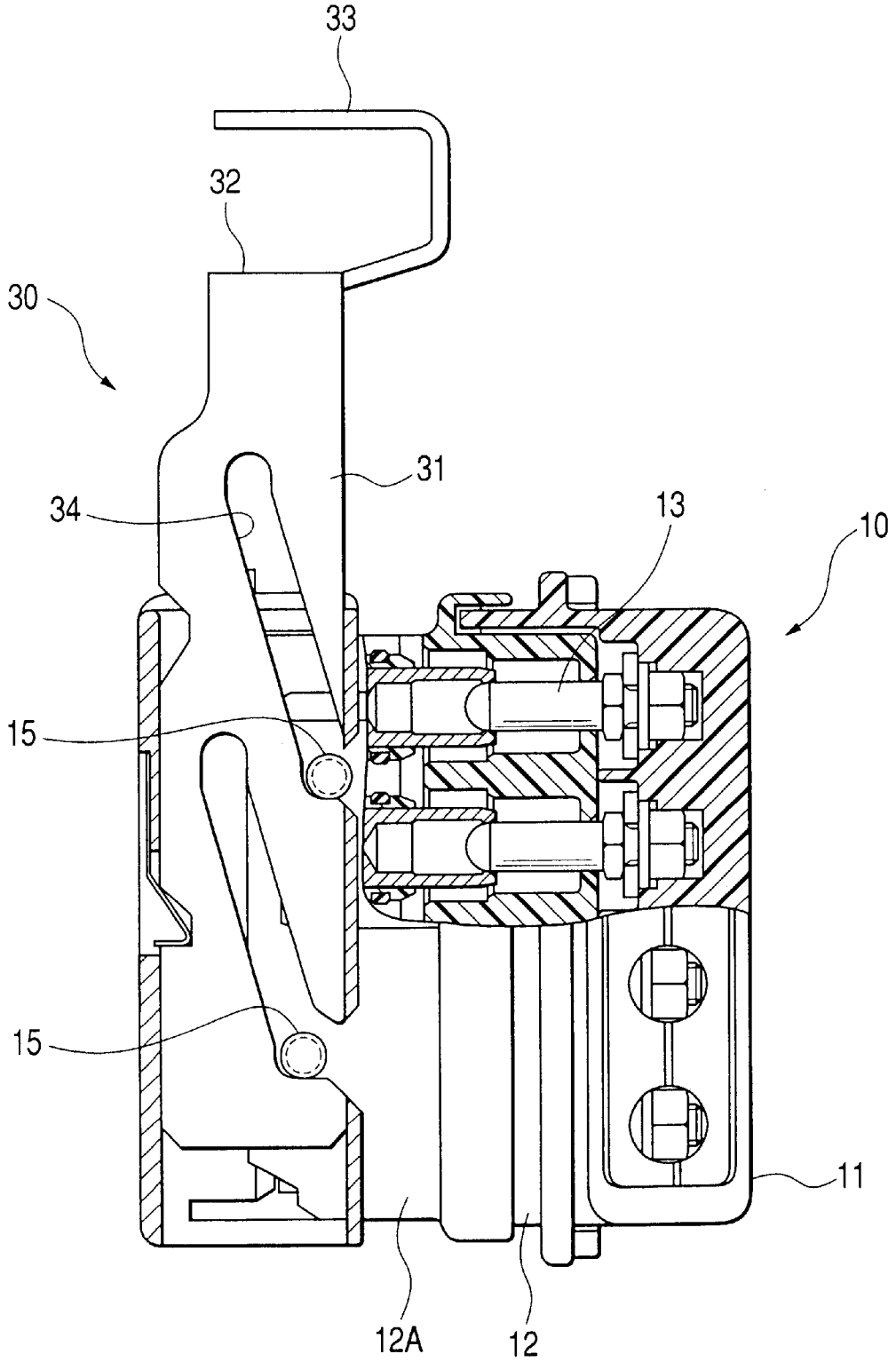
FIG. 2 is a cross-sectional view showing a movable plate and idle pin.
Figure 3:
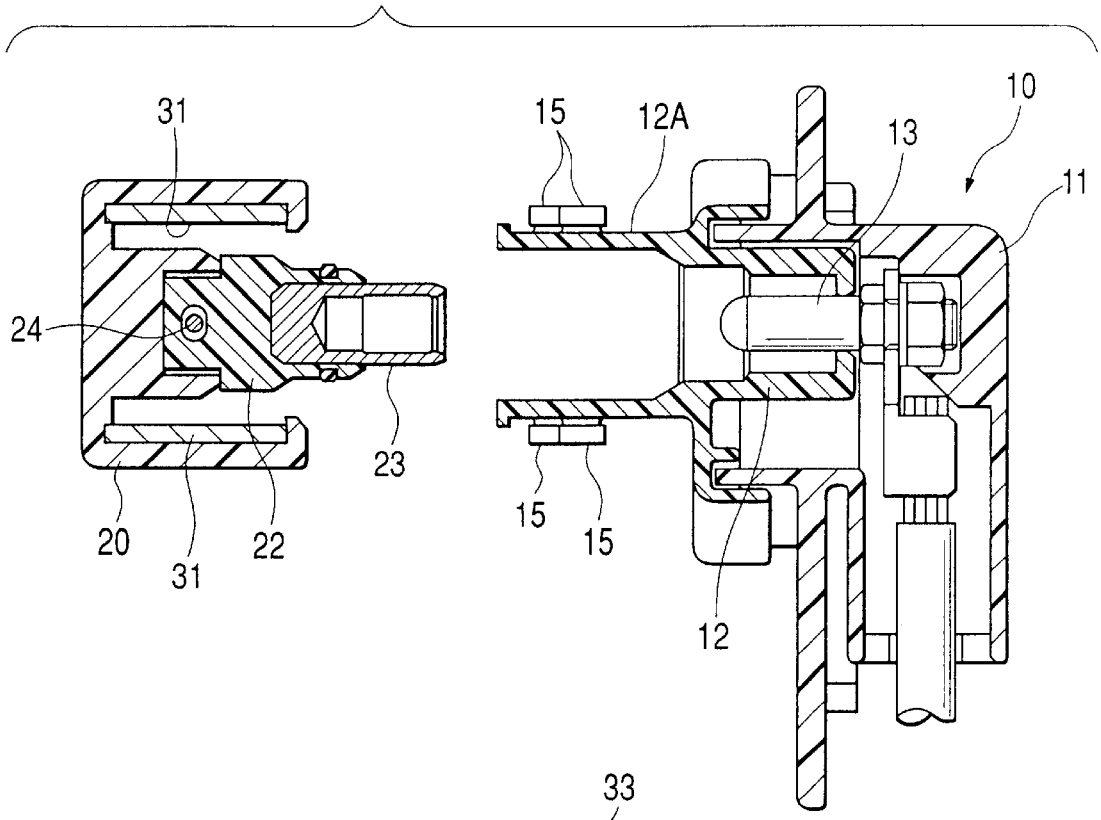
FIG. 3 is a cross-sectional view taken on line 3—3 in FIG. 1.

In the cover housing 12 of the stationary side housing 10, there is provided a hood section 12A, only the upside of which is open in FIG. 1. Corresponding to the hood section 12A, in the movable side housing 20, there is provided a slit 25 in which the hood section 12A is accommodated. Accordingly, the movable side housing 20 is guided by the hood section 12A and capable of moving only in the engaging direction of the movable electrode 23 with the stationary electrode 12, which functions as a guide rail for guiding the movable electrode 23 in the engaging direction with the stationary electrode 13. Further, as shown in FIGS. 2 and 3, on the side wall in the longitudinal direction of the hood section 12A, two idle pins 15 are respectively provided being protruded.

Figure 4:
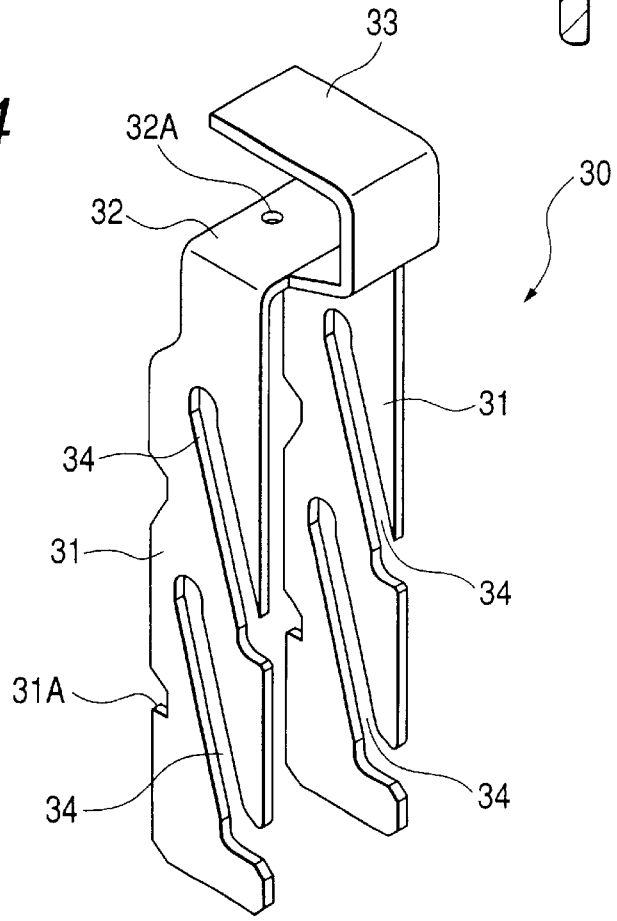
FIG. 4 is a perspective view showing a c am m ember.

FIG. 4 is a view showing a drive member 30 to cooperate with the idle pin 15. This drive member 30 includes: two movable plates 31, 31 arranged in the longitudinal direction of the movable side housing 20; a connecting section 32 for connecting end portions of the movable plates 31, 31; and a handle section 33 extending from the connecting section 32, wherein these sections are formed from one steel sheet by press forming. The movable plate 31 is accommodated and moved in the slit 26 which is formed in the longitudinal direction of the movable side housing 20. However, the movable plate 31 can not be moved in the face direction of the slit 26, that is, the movable plate 31 can not be moved in the engaging direction of the movable electrode 23 with the stationary electrode 13. On this movable plate 31, there are provided two oblique grooves 34 which are open at one side edge section facing the stationary side housing 10 and separate from the one side edge section as they come to the handle section 33 side. The idle pin 15 can be introduced into each of the two oblique grooves 34. When the idle pin 15 is introduced into each oblique groove 34 and the movable plate 31 is moved downward in FIG. 1, by the cam action between the oblique groove 34 and the idle pin 15, the movable plate 31 is moved toward the stationary side housing 10, that is, the movable side housing 20 is moved toward the stationary side housing 10. As a result, the movable electrode 23 is engaged with the stationary electrode 13. In this connection, in the connecting section 32, there is provided a through-hole 32A into which an end of the connecting pin 24 of the movable side housing 20 can be inserted. Therefore, when the movable electrode 23 is completely engaged with the stationary electrode 13, the end of the connecting pin 24 penetrates the through-hole 32A.

In this connection, the handle section 33 is formed into a C-shape so that a worker's finger can be hooked at the handle section 33. On the opposite side to the side edge section on the opening side of the oblique groove 34 of the movable plate 31, there is provided a notch 31A as shown in FIG. 4. When the movable plate 31 is drawn out at maximum from the slit 26 of the movable side housing 20, the leaf spring 27 arranged in the movable side housing 20 engages with the notch 31A, so that the drive member 30 can be kept in a state in which it has been drawn out from the slit 26 of the movable side housing 20 as shown in FIG. 1.

The arrangement of this embodiment has been described above. Next, the mode of operation will be explained below. When the movable side housing 20 is separate from the stationary side housing 10, a circuit formed between the stationary electrodes 13 is electrically open. In order to close the circuit, first, in the state shown in FIG. 1, a group of the movable electrodes 23 are made to get into the hood section 12A. Then, the group of the movable electrodes 23 are moved in the lateral direction until the oblique groove 34 of the movable plate 31 comes into contact with the idle pin 15. Since an upper portion of the hood section 12A is open, the group of the movable electrodes 23 are moved downward in the state shown in FIG. 1, and then they are moved in the lateral direction.

Figure 5:
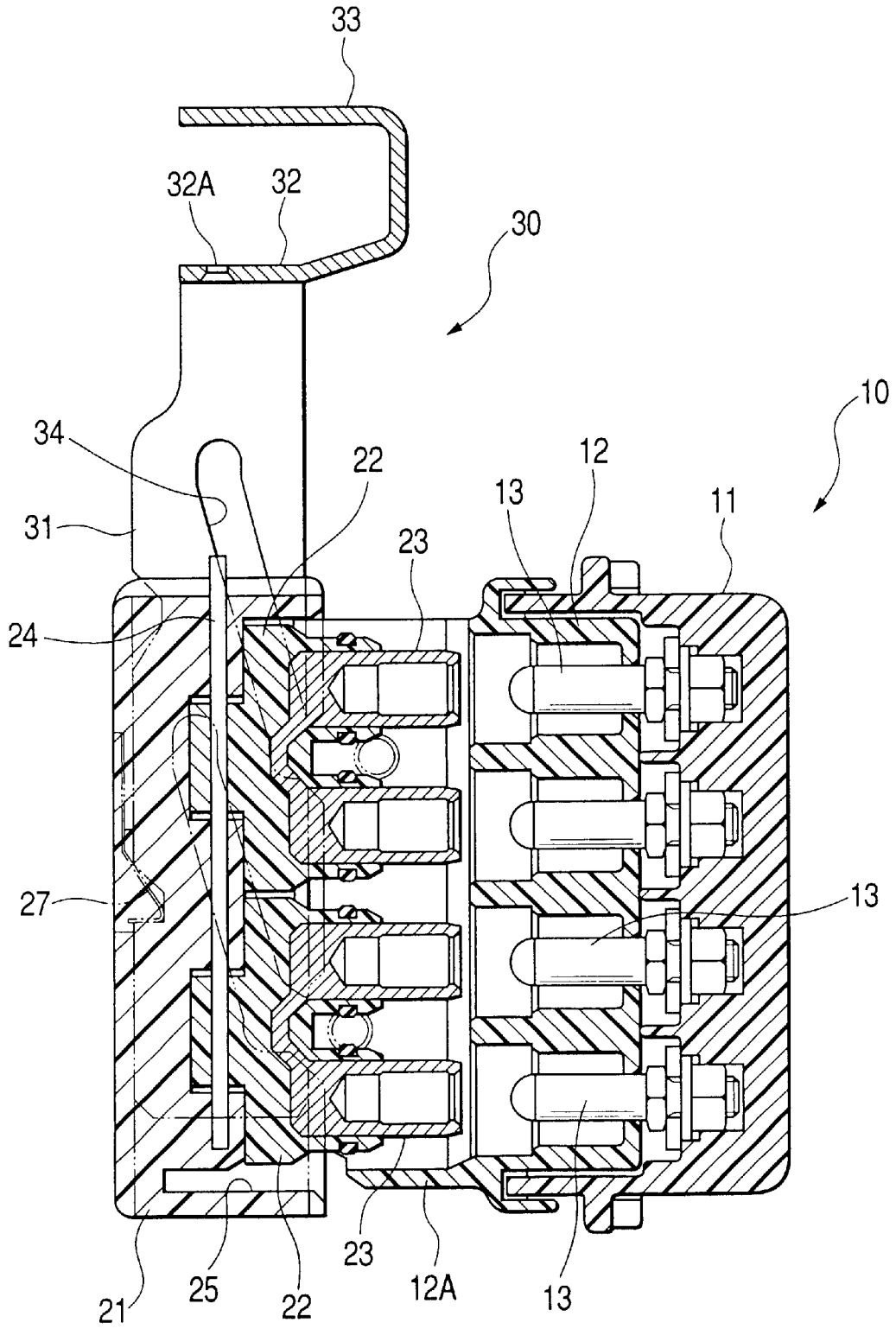
FIG. 5 is a cross-sectional view showing a state in the middle of engagement.

When the idle pin 15 of the stationary side housing 10 enters the oblique groove 34, the movable electrode 23 is a little engaged with the stationary electrode 13 as shown in FIG. 5. After that, when the handle section 33 of the drive member 30 is strongly pushed with a hand of a worker, the idle pin 15 gets into the far side of the oblique groove 34 while it is being guided. Since the movable plate 31 is incapable of moving with respect to the movable side housing 20 in the engaging direction of the movable electrode 23 with the stationary electrode 13, the movable plate 31 is given a strong force so that it can be moved toward the stationary side housing 10. Therefore, the movable electrode 23 is engaged with the stationary electrode 13 while the force given to the movable electrode 31 overcomes an engagement resistance.

Figure 6:
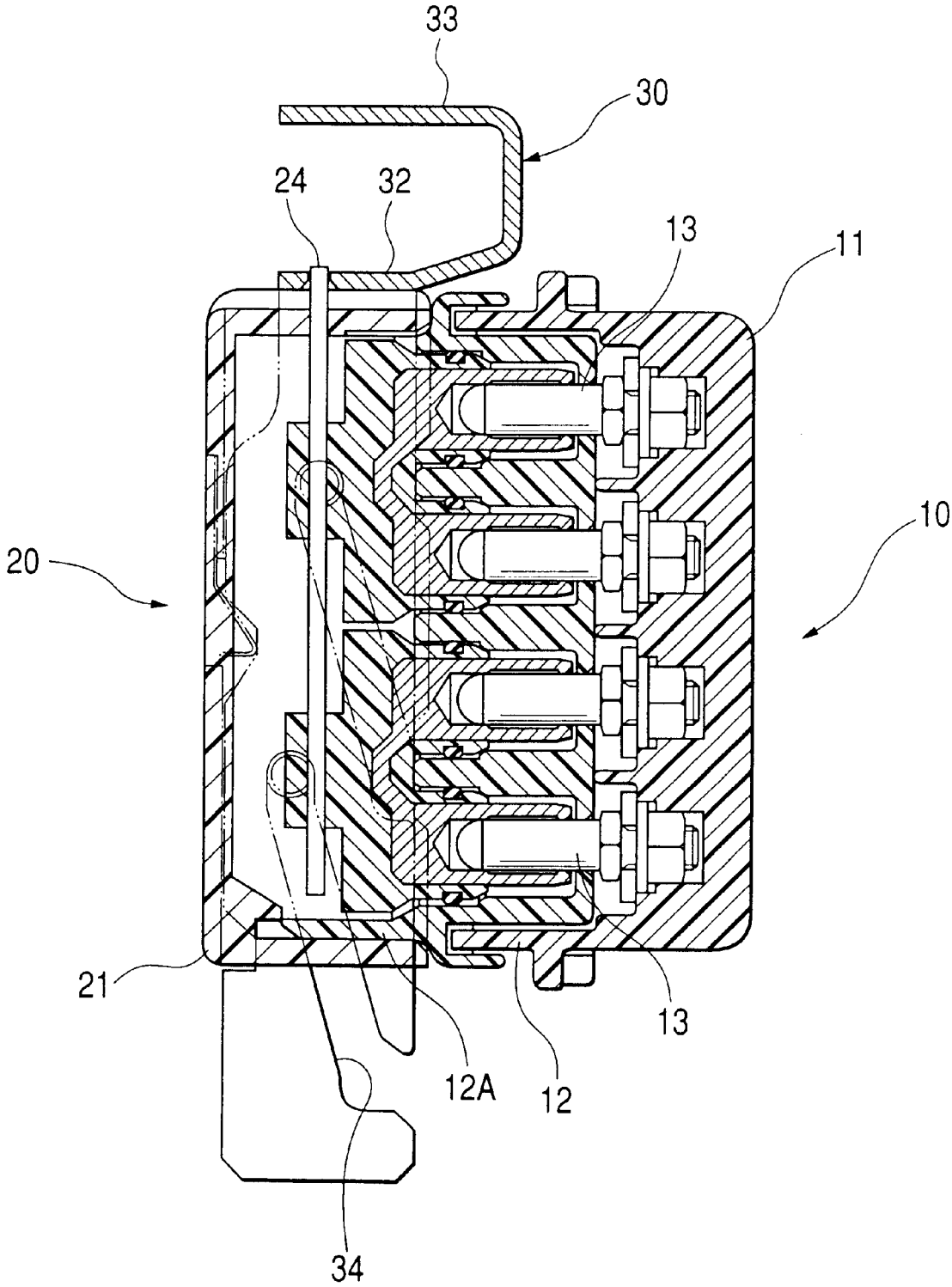
FIG. 6 is a cross-sectional view showing a state at the end of engagement.

When the drive member 30 is completely pushed into and the movable electrode 23 is completely engaged with the stationary electrode 13 as shown in FIG. 6, the detecting protrusion 24A penetrates the through-hole 32A of the drive section 30. Since the forward end of the detecting protrusion 24A is coated with red coating, the red coating can be seen in a portion of the connecting section 32. Accordingly, it can be judged that the engagement work has been completed. In this way, the worker can complete the engagement work at this time.

In order to open the circuit formed between the stationary electrodes 13 in this state, the worker may put his finger at the handle section 33 and draw it upward, which is contrary to the procedure described before. When the cam member 31 is drawn out, the movable side housing 20 is separate from the stationary side housing 10. At a point of time when the movable electrode 23 has been completely disengaged from the stationary electrode 13, the movable side housing can be drawn out upward.

As described above, according to the present embodiment, although the engaging direction of the movable electrode 23 with the stationary electrode 13 is lateral, the handle section 33 may be moved upward and downward when the engaging and disengaging work is conducted. Accordingly, for example, even if this breaker device is arranged in a small engine room and a sufficiently large space is not provided on the side of the breaker device, the circuit can be easily connected and disconnected.

Further, the present embodiment has the following advantages. Since a pair of the movable plates 31 are arranged in the longitudinal direction of the movable side housing 20, a force caused by the cam action is well balanced. Therefore, the movable electrode 23 can be smoothly engaged with and disengaged from the stationary electrode 13.

Further, the through-hole 32A is formed in the connecting section 32 to connect the two movable plates 31, and the detecting protrusion 24A penetrates the through-hole 32A when both the electrodes 13 and 23 have been engaged with each other. Due to the above arrangement, it is possible to observe from the operation side that the engagement work has been completed, which is convenient. In this case, since red coating is coated on the detection protrusion 24A, the confirmation can be more easily made.

Another Embodiment

It should be noted that the present invention is not limited to the above embodiment explained referring to the drawings. For example, the following embodiments are included in the technical scope of the present invention. Further, variations may be made by one skilled in the art without departing from the spirit and scope of the present invention.

(1) In the above embodiment, the two short-circuited movable electrodes 23 are engaged with the two pin-shaped stationary electrodes 13. However, the present invention is not limited to the above specific structure but the following structure may be adopted. Two tongue-shaped stationary electrodes, which are formed into a pair, are arranged on both sides of one insulating support. C-shaped movable electrodes are engaged with these two stationary electrodes so that both the stationary electrodes can be short-circuited.

(2) A fuse device may be additionally arranged in this breaker device. Alternatively, a switch to detect that the movable side housing has been engaged with the stationary side housing may be additionally arranged in this breaker device.

What is claimed is:

1. A breaker device comprising:

a stationary side housing having a pair of stationary electrodes which are insulated from each other;

a movable side housing having a pair of movable electrodes for putting both said stationary electrodes in a state of electrical continuity when said movable electrodes are engaged with said pair of stationary electrodes;

a guide rail arranged in both said housings, for guiding both said housings in an engaging direction of said movable electrode with said stationary electrodes;

an idle pin provided in said stationary side housing;

a movable plate arranged in said movable side housing, incapable of moving in the engaging direction of said movable electrode with said stationary electrodes, capable of moving in a direction perpendicular to the engaging direction of said movable electrode with said stationary electrodes; and an oblique groove open to a side edge of said movable plate opposed to said stationary side housing, the oblique groove being oblique to a moving direction of said movable plate and engageable with the idle pin.

2. The breaker device according to claim 1, wherein two movable plates are provided along the inside of a pair of side walls of said movable side housing, said two movable plates are connected with each other at one end side being formed into a C-shape, and a handle section is integrally formed in the connecting section thereof.

3. The breaker device according to claim 2, wherein a through-hole is formed in said connecting section, a detecting protruding section capable of entering the through-hole is formed on a wall corresponding to said connecting section in said movable side housing, and the oblique groove of said movable plate is set so that both said electrodes are engaged with each other when said detecting protruding section is moved penetrating the through-hole.

4. The breaker device according to claim 3, wherein said detecting protruding section is formed at an end of a connecting pin for attaching said movable electrode to said movable side housing.

5. The breaker device according to claim 3, wherein the end of said detecting protruding section is of a different color from that of said connecting section.

* * * * *

UNITED STATES PATENT AND TRADEMARK OFFICE

CERTIFICATE OF CORRECTION

PATENT NO. : 6,506,985 B2 
DATED : January 14, 2003
INVENTOR(S) : Kazumoto Konda It is certified that error appears in the above-identified patent and that said Letters Patent is hereby corrected as shown below:

Title page,
Item [73], Assignee, change "Autoneworks Technologies, Ltd." to -- Autonetworks Technologies, Ltd. --.

Signed and Sealed this

Nineteenth Day of August, 2003

JAMES E. ROGAN
*Director of the United States Patent and Trademark Office*